US007896745B2

(12) United States Patent
Youm

(10) Patent No.: US 7,896,745 B2
(45) Date of Patent: Mar. 1, 2011

(54) SYSTEM FOR PROVIDING GO-STOP GAME SERVICE VIA ON-LINE AND METHOD THEREFOR

(75) Inventor: Eui Joon Youm, Seoul (KR)

(73) Assignee: NHN Corporation, Seongnam-si (KR)

( * ) Notice: Subject to any disclaimer, the term of this patent is extended or adjusted under 35 U.S.C. 154(b) by 811 days.

(21) Appl. No.: 11/814,018

(22) PCT Filed: Dec. 22, 2005

(86) PCT No.: PCT/KR2005/004470

§ 371 (c)(1),
(2), (4) Date: Jul. 16, 2007

(87) PCT Pub. No.: WO2006/078093

PCT Pub. Date: Jul. 27, 2006

(65) Prior Publication Data

US 2008/0194309 A1 Aug. 14, 2008

(30) Foreign Application Priority Data

Jan. 18, 2005 (KR) ..... 10-2005-0004487

(51) Int. Cl.
*A63F 9/24* (2006.01)

(52) U.S. Cl. ..... 463/43; 463/42

(58) Field of Classification Search ..... 463/43, 463/42

See application file for complete search history.

(56) References Cited

U.S. PATENT DOCUMENTS 7,297,063 B2 * 11/2007 Fujisawa et al. ..... 463/43
7,645,193 B2 * 1/2010 Oh ..... 463/11
2004/0063484 A1 * 4/2004 Dreaper et al. ..... 463/16
2008/0287174 A1 * 11/2008 Park et al. ..... 463/3
2009/0258709 A1 * 10/2009 Yamagami et al. ..... 463/43
2010/0113162 A1 * 5/2010 Vemuri et al. ..... 463/42

FOREIGN PATENT DOCUMENTS

JP 2001-310083 11/2001
JP 2003-265863 9/2003
JP 2003-320168 11/2003

(Continued)

OTHER PUBLICATIONS

Install Quick-Understanding Plus! 98 for Windows 98, Aug. 1998, I/O, Aug. 1, 1998, p. 33, p. 36, vol. 23, No. 8 (Serial No. 262), Gonghak Corporation, Japan.

(Continued)

*Primary Examiner*—Pierre E Elisca
(74) *Attorney, Agent, or Firm*—H.C. Park & Associates, PLC

(57) ABSTRACT

An online GOSTOP game providing method and system which can support a GOSTOP game using a plurality of decks of cards and improve a user's interests through various types of records is provided. Namely, a GOSTOP game service using a plurality of decks of cards is provided. Through this, point calculation and modified game method by various combinations of cards are applied in the GOSTOP game service. Accordingly, it is possible to construct an online GOSTOP game providing system which can increase interests of a user playing a GOSTOP game.

22 Claims, 8 Drawing Sheets

FOREIGN PATENT DOCUMENTS

| | | |
|---|---|---|
| KR | 2000-9588 | 6/2000 |
| KR | 2003-0041497 | 5/2003 |
| KR | 10-2004-0032847 | 4/2004 |
| KR | 2004-0037650 | 5/2004 |
| KR | 2004-0052733 | 6/2004 |
| WO | WO 2003-098513 | 11/2003 |

OTHER PUBLICATIONS

Kimura Kentaro, cards and flower cards game, a methodof getting victory, Gotosyoin Corporation, Nov. 1996, p. 26, p. 193-194, ISBN 4-340-07301-6, Japan.

PlayStation 2 Complete Attack Series 1 Golf Paradise Complete Guidebook, Futaba Corporation, May 30, 2000, first edition, p. 9.

* cited by examiner

| NO | CARD DATA | | | | | NO | CARD DATA | | | | |
|---|---|---|---|---|---|---|---|---|---|---|---|
| | KWANG | 10GGUT | 5GGUT | PI | PI | | KWANG | 10GGUT | 5GGUT | PI | PI |
| 1 |  | |  |  |  | 8 |  |  | |  |  |
| 2 | |  |  |  |  | 9 | |  |  |  |  |
| 3 |  | |  |  |  | 10 | |  |  |  |  |
| 4 | |  |  |  |  | 11 |  |  | |  |  |
| 5 | |  |  |  |  | 12 |  |  |  | | |
| 6 | |  |  |  |  | BONUS |  |  | | | |
| 7 | |  |  |  |  | | | | | | |

| CARD COMBINATION DATA | CARD DATA | POINT DATA |
|---|---|---|
| GODORI |  | 5 POINTS |
| |  | 20 POINTS (WEIGHT INFORMATION × 4) |

FIG. 5

| PENALTY NAME | APPLICATION CONDITION | PENALTY INFORMATION |
|---|---|---|
| KWANGBAK (WHEN A WINNER OBTAINS POINTS WITH KWANGS) | WHEN AT LEAST ONE KWANG IS OBTAINED | × 2 |
| | WHEN NO KWANG IS OBTAINED | × 4 |
| PIBAK (WHEN A WINNER OBTAINS POINTS WITH PIS) | WHEN LESS THAN OR EQUAL TO 12 PIS ARE OBTAINED (WHEN PI IS 0, PENALTY IS NOT APPLIED) | × 2 |

< GAME TEAM >

FIRST USER

SECOND USER

SYSTEM FOR PROVIDING GO-STOP GAME SERVICE VIA ON-LINE AND METHOD THEREFOR

CROSS REFERENCE TO RELATED APPLICATIONS

This application is a U.S. National Phase Application of International Application PCT Application No. PCT/KR2005/004470 filed on Dec. 22, 2005, which claims the benefit of priority from Korean Patent Application No. 10-2005-0004487 filed on Jan. 18, 2005. The disclosures of International Application PCT Application No. PCT/KR2005/004470 and Korean Patent Application No. 10-2005-0004487 are incorporated herein by reference.

TECHNICAL FIELD

The present invention relates to a method and system for providing an online GOSTOP game which can improve a user's interests in a game by supporting a GOSTOP game capable of generating various types of records.

BACKGROUND ART

GOSTOP is played with small thick cards with flower designs. The cards are called HWA-TU in Korea, and HANAFUDA in Japan.

While distribution of the Internet develops, services providing various types of contents via the Internet are currently appearing. From a perspective of market expansion and distribution speed, a game content providing service is growing most dramatically among content providing services.

The online game content providing service helps a user to play the same game with an unspecified person without the limits on time and place. In the case of a GOSTOP game via the Internet, its game content service is provided in a known game method. Also, the GOSTOP game via the Internet stands out remarkably among many currently provided game services.

However, in the case of most online GOSTOP games which are being provided, when a user obtains a pair of cards and reaches a certain point, a condition of winning a game is achieved. After achieving the condition, if the user continues the game and obtains an additional point, more winning points in which, for example, a monetary compensation, is given to the user. Namely, an offline GOSTOP game method is embodied online only as is. In the case of the conventional GOSTOP game, a user may easily play a game, but may have not fun and interest with something which is different from an existing offline game.

Accordingly, a new GOSTOP game module which can diverge from the conventional game method and generate something different and interesting by supporting a GOSTOP game service using a plurality of decks of cards is needed.

DISCLOSURE OF INVENTION

Technical Goals

The present invention is conceived to solve the aforementioned problem in the conventional art. Thus, the present invention provides an online GOSTOP game providing method and system which can provide a GOSTOP game service using a plurality of decks of cards and, through this, calculate points according to various combinations of cards and apply a different game method from the conventional GOSTOP game, thereby improving interest of a user playing a GOSTOP game.

The present invention also provides an online GOSTOP game providing method and system in which matching is performed when a plurality of card data is of a same kind or identical, and various types of card data can be obtained by assigning a predetermined weight to certain combinations of card data when calculating a point.

The present invention also provides an online GOSTOP game providing method and system which can improve a user's interests and fun by supporting various types of team play, when a GOSTOP game using a plurality of decks of cards is in progress.

Technical Solutions

To achieve the above objectives of the present invention, according to an aspect of the present invention, there is provided an online GOSTOP game providing system including: a user information database recording account information of at least one user and game point information thereof; a channel management module providing at least one user with a list of accessible game channels, in response to a request for providing a GOSTOP game service from the at least one user; an information transmission module receiving a selection signal pertaining to the list of game channels from the user and transmitting information on a game channel corresponding to the selection signal and client data necessary for progressing the GOSTOP game, to user terminals of a plurality of users accessing the game channel; a record database recording predetermined point data or weight information corresponding to a card combination data which is at least one combination of card data; a game control module distributing the card data to the user according to a predetermined algorithm, analyzing the card data obtained by the user according to the user's manipulation, generating the card combination data, and extracting point data or weight information corresponding to the card combination data by referring to the record database, the algorithm randomly distributing at least two decks of cards to a user playing the game as card data; and a point calculation module calculating total point information obtained by the user by using the point data or the weight information and providing the user with the calculated total point information.

According to another aspect of the present invention, there is provided an online GOSTOP game providing method including the steps of: maintaining a user information database recording account information of at least one user and game point information thereof and a record database recording predetermined point data or weight information corresponding to card combination data which is at least one combination of card data; providing the at least one user with a list of accessible game channels, in response to a request for providing a GOSTOP game service from the at least one user; receiving a selection signal pertaining to the list of game channels from the user and transmitting information on a game channel corresponding to the selection signal and client data necessary for progressing the GOSTOP game, to user terminals of a plurality of users accessing the game channel; randomly distributing at least two decks of cards, as card data, to a user playing the game, analyzing card data obtained by the user according to the user's manipulation, generating card combination data, and extracting point data or weight information corresponding to the card combination data by referring to the record database; and calculating total point information obtained by the user by using the extracted point data or weight information and providing the user with the calculated total point information.

BRIEF DESCRIPTION OF DRAWINGS

FIG. 5 is a diagram illustrating an example of a record database recording penalty information applied to a loser according to a winner's combination of cards after a game is over, according to another embodiment of the present invention;

BEST MODE FOR CARRYING OUT THE INVENTION

Figure 1:
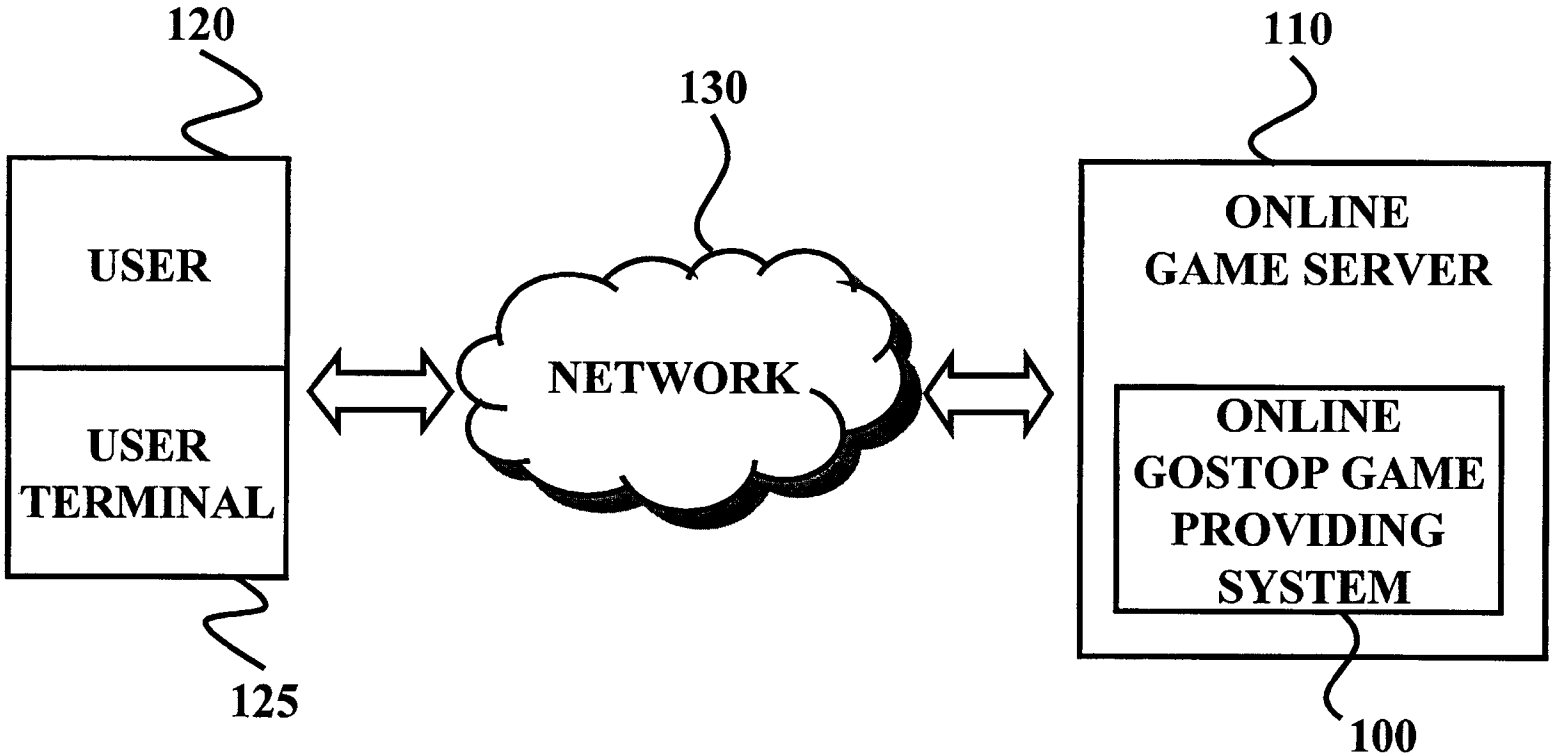
FIG. 1 is a diagram illustrating a schematic configuration of an online GOSTOP game providing system according to an embodiment of the present invention.

Hereinafter, an online GOSTOP game providing system and method will be described with reference to the accompanying drawings.

A GOSTOP game according to an embodiment of the present invention is a modified general MATGO GOSTOP game method in which two users play a game. Also, the GOSTOP game is in the type of MATGO and in progress by using a plurality of decks of cards. In this instance, a deck of cards may include basic cards consisting of 12 kinds/48 cards, and a predetermined number of bonus cards. Each kind may be classified into four classes, such as KWANG, 10GGUT, 5GGUT and PI, according to its picture. Namely, in the GOSTOP game according to the present invention, at least two users play a game using a plurality of decks of cards as described above. Accordingly, as an example of the present invention, progress of a GOSTOP game using two decks of cards will be described.

In the above GOSTOP game, cards may include 96 (48*2) basic cards and four bonus cards (two cards for each 2PI/3PI). A portion (e.g., 20 cards) out of a total number of cards is allotted to each user participating in the game (distribution cards). Also, a portion (e.g., 16 cards) of undistributed cards is displayed to show its picture (BADAK cards) and a remaining 44 cards not showing their picture (waiting cards) are sequentially distributed to a corresponding user in each user's betting turn.

The above game may utilize a general GOSTOP game method as is. An online GOSTOP game providing system according to the present embodiment compares one card selected by a user from distribution cards and a waiting card allotted for the user with BADAK cards, and records a pair of matched cards in a predetermined record unit as the user's obtained cards. In this instance, the matching may be performed when a correlation between compared cards is of the same kind or identical. When not matching, for example, when there is not a same kind of or an identical card among BADAK cards in a user's betting turn, the selected distribution card or the waiting card allotted for the user is changed into a BADAK card. Winning or losing of a game may be arbitrarily determined by an operator of the present system. The online GOSTOP game providing system according to the present embodiment generates a combination of cards by combining a user's obtained cards, assigns a predetermined weight to point data corresponding to the generated combination of cards, and calculates the total points. When the total points reach a certain value, the online GOSTOP game providing system determines winning or losing of the game according to the user's selection on the termination of the game. In this instance, the generated combination of cards may be in various types of combinations (e.g., two combinations of GODORI which consist of 6 cards of identical pairs which may not be generated in the conventional GOSTOP game using a deck of cards. A point or weight to be applied to each combination may be variously determined by the operator of the present system.

FIG. 1 is a diagram illustrating a schematic configuration of an online GOSTOP game providing system according to an embodiment of the present invention.

An online GOSTOP game providing system 100 enables a GOSTOP game to be played between users 120 according to an algorithm corresponding to a general MATGO game method. According to the game in progress, the online GOSTOP game providing system 100 generates a combination of cards by combining cards obtained by each user 120 and calculates total point information for each user 120 by summing up points corresponding to the generated combination of cards. Also, when the calculated total point information of the user 120 reaches a certain value, the online GOSTOP game providing system 100 may assign a right to the user 120 satisfying the value (winner), to terminate a corresponding game via a predetermined user interface. When the user 120 (winner) generates a game termination signal, the online GOSTOP game providing system 100 deducts a predetermined amount of game point information from another user (loser) and adds the same to the winner's point information, and records the results of the addition. In this manner, the online GOSTOP game providing system 100 processes results according to termination of a game.

In the present embodiment, the online GOSTOP game providing system 100 adopts a GOSTOP game method using a plurality of decks of cards. Accordingly, a modified combination of cards may be generated to have a matching of cards which are different from an existing game method or various types of combinations. Also, the online GOSTOP game providing system 100 may provide the user 120 with various entertainments which may not be found in the conventional GOSTOP game (MATGO). In the present embodiment, the online GOSTOP game providing system 100 describes that an online based game, particularly, a GOSTOP game, is performed between at least two users 120 who are separated from each other in a network. However, this is only for convenience of description and the present invention is not limited thereto. Also, it will be apparent to those skilled in the related art that the present invention may be applicable to not only an online based game but also a personal computer based game or a video console based game.

An online game server 110 is connected to a user terminal 125 of the user 120 via a wired/wireless network 130. Also, the online game server 110 functions to provide the user 120 with all types of game services, including a GOSTOP game service, in a network. When the user 120 who has installed a game related program in the user terminal 125 accesses the online game server 110, predetermined client data or a game patch necessary for a game is transmitted to the user terminal 125. A game service in the online game server 110 may be provided via the game related program (GOSTOP game program) activated by the client data or game patch.

The user 120 may be an Internet user who has the user terminal 125 for access to the network 130, receives client data or a game patch from the online game server 110 and receives a game service including a GOSTOP game service according to an embodiment of the present invention.

The user terminal 125 maintains a connection state with the online game server 110 via the network 130 such as Internet, telephone line, and the like, and embodies a GOSTOP game service online. The user terminal 125 has predetermined calculation ability by including a predetermined memory and predetermined microprocessor, such as a personal computer, a handheld computer, a personal digital assistant (PDA), a mobile phone, and a smart phone.

The online GOSTOP game providing system 100 performs a MATGO game using a plurality of decks of cards. Accordingly, matching or a combination of cards by identical cards, which may not be performed in an existing MATGO game using a deck of cards, may be performed. Hereinafter, a configuration of an online GOSTOP game providing system 200 will be described with reference to FIG. 2.

Figure 2:
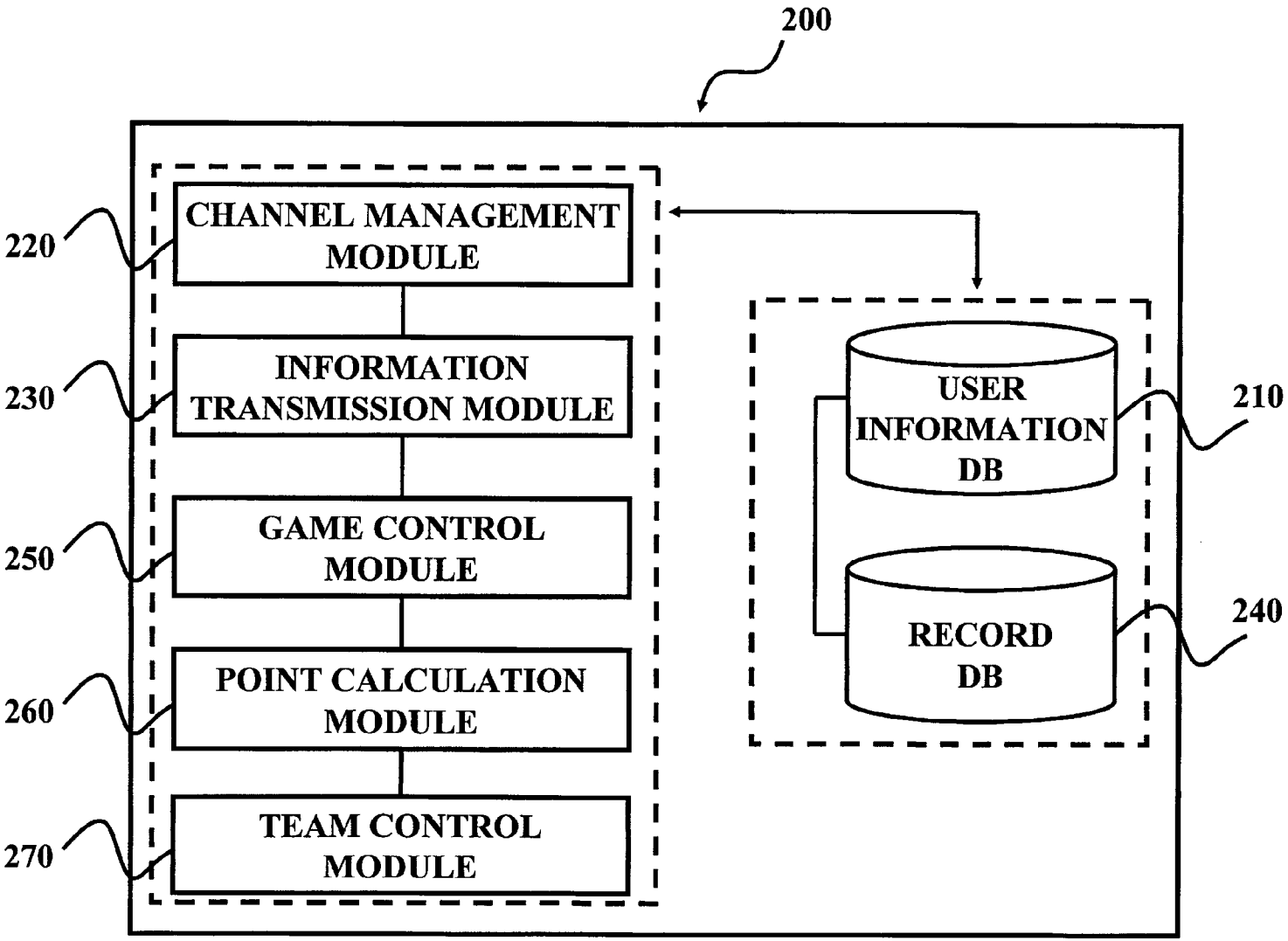
FIG. 2 is a configuration diagram illustrating an online GOSTOP game providing system according to an exemplary embodiment of the present invention.

FIG. 2 is a configuration diagram illustrating an online GOSTOP game providing system according to an exemplary embodiment of the present invention.

The online GOSTOP game providing system 200 may include a user information database 210, a channel management module 220, an information transmission module 230, a record database 240, a game control module 250 and a point calculation module 260.

The user information database 210 records account information of at least one user 120 and game point information thereof. Namely, the user information database 210 stores account information (e.g., a user identifier, an access IP) of the user 120 receiving a GOSTOP game service and game point information thereof for each user 120. In this instance, the game point information is information on points which are utilized for playing an online GOSTOP game. Also, the game point information may be information on a numerical value which is utilized for compensations according to participation, betting, and winning or losing of a game.

The channel management module 220, in response to a request for providing a GOSTOP game service from at least one user 120, provides the user 120 with a list of game channels that the user 120 can access. A game channel identifies a game room in which a GOSTOP game is independently in progress. A game channel of a currently accessible game room in the list of game channels may be indicated using a color or the like. Namely, when the user 120 accesses the online GOSTOP game providing system 200 according to the present embodiment, the channel management module 220 searches for a game channel capable of providing the user 120 with a GOSTOP game service, includes the found game channel in the list of game channels and provides the user 120 with the same.

The information transmission module 120 receives a selection signal pertaining to the list of game channels from the user 120, and transmits information on a game channel corresponding to the selection signal and client data necessary for playing the GOSTOP game, to the user terminal 125 of the user 120 accessing the game channel. In this instance, information on an accessible game channel may be defined as all types of information associated with a game channel (a game room) that the user 120 accesses. As an example, the information may include ability/level information of other users who access the game channel and play the same game, game participation fee information, information on a maximum number of users, and the like. Also, the client data is information on a game progress. As an example, the client data may receive game point information, as a participation fee, from the user 120 accessing a game room and enable a GOSTOP game to be played between a plurality of users 120 who have received the game point information.

The record database 240 records predetermined point data or weight information corresponding to card combination data which is at least one combination of card data. The combination of cards generated by a game method of the present invention is a MATGO GOSTOP game using a plurality of decks of cards. Accordingly, various types of combinations of cards, which may not be generated in the conventional GOSTOP game using one deck of cards, may be generated. Also, weight information with respect to a particular combination of cards may be set.

As an example, in a GOSTOP game using two decks of cards, it may be permitted to combine combinations of cards using a plurality of identical cards, with respect to GODORI, HONGDAN, CHUNGDAN, CHODAN, OKWANG, etc. Also, the record database 240 may assign a different weight to each combination of cards. As an example, when the generated combination of cards includes a plurality of identical cards, a higher weight may be assigned thereto than a general combination of cards.

Hereinafter, the record database 240 will be described in detail with reference to FIGS. 3 to 5.

Figure 3:
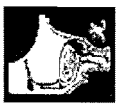
FIG. 3 is a diagram illustrating an example of a configuration of a general deck of cards.
Figure 3:
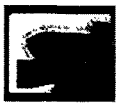
Figure 3:
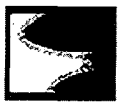
Figure 3:
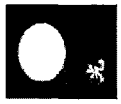
Figure 3:
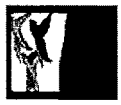
Figure 3:
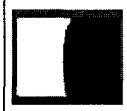
Figure 3:
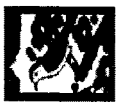
Figure 3:
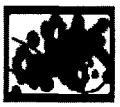
Figure 3:
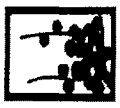
Figure 3:
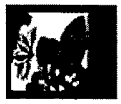
Figure 3:
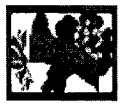
Figure 3:
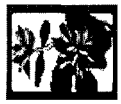
Figure 3:
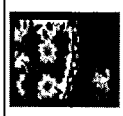
Figure 3:
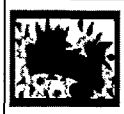
Figure 3:
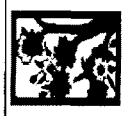
Figure 3:
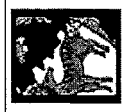
Figure 3:
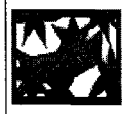
Figure 3:
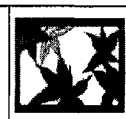
Figure 3:
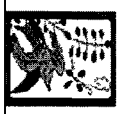
Figure 3:
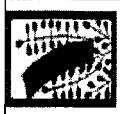
Figure 3:
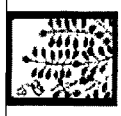
Figure 3:
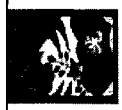
Figure 3:
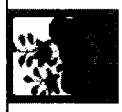
Figure 3:
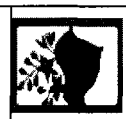
Figure 3:
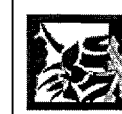
Figure 3:
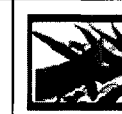
Figure 3:
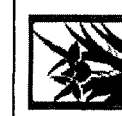
Figure 3:
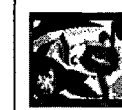
Figure 3:
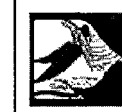
Figure 3:
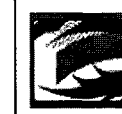
Figure 3:
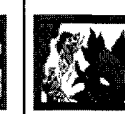
Figure 3:
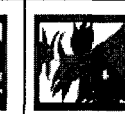
Figure 3:
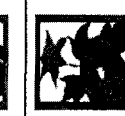
Figure 3:
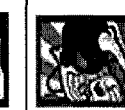
Figure 3:
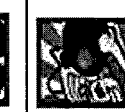
Figure 3:
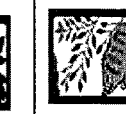
Figure 3:
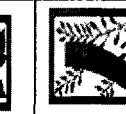
Figure 3:
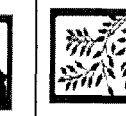

FIG. 3 is a diagram illustrating an example of a configuration of a general deck of cards.

As illustrated in FIG. 3, a deck of cards includes basic cards consisting of 12 kinds/48 cards and a predetermined number of bonus cards. An identification number from 1 to 12 is assigned to each kind. Cards belonging to each kind are classified into four classes, such as KWANG 10GGUT, 5GGUT and PI. Also, each card may have a unique name. As an example, a card which is assigned with identification number 12 and indicated by KWANG may be named as "BIKWANG" The online GOSTOP game providing system 200 enables a GOSTOP game to be played between a plurality of users 120 using a plurality of decks of cards which is constructed as described above.

Figure 4:
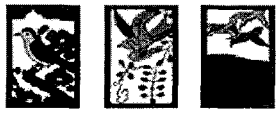
FIG. 4 is a diagram illustrating an example of a record database recording point data and weight information corresponding to card combination data, according to an embodiment of the present invention.
Figure 4:
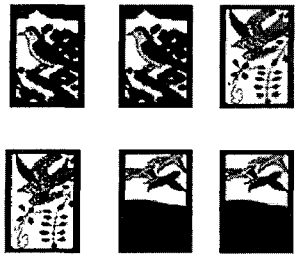

FIG. 4 is a diagram illustrating an example of a record database recording point data and weight information corresponding to card combination data, according to an embodiment of the present invention.

As illustrated in FIG. 4, a GOSTOP game according to the present embodiment uses a plurality of decks of cards. Accordingly, various types of combinations of cards, which may not be combined in a GOSTOP game using one deck of cards, may be generated.

Namely, the record database 240 includes weight information corresponding to each combination of cards. In this instance, the weight information is information to be multiplied with point data of a particular combination of card data obtained by the user 120.

When card combination data combined by card data which is obtained by the user 120 in a game is a combination not generated in the conventional GOSTOP game or its possibility is comparatively lower, the game control module 250 applies an additional weight to existing point data and assigns high point data of a corresponding combination to the user 120.

Particular combinations, which may be applied by the aforementioned weight, may include possible combinations in a GOSTOP game method of the present invention using a plurality of decks of cards, for example, at least a predetermined number of combinations of KWANG cards, at least a predetermined number of combinations of PI cards, two combinations of GODORI cards, two combinations of CHUNGDAN cards, two combinations of HONGDAN cards and two combinations of CHODAN cards.

Referring to FIG. 4, point data '5points' corresponds to 'GODORI' which is card combination data generated by using three 10GGUT cards of 'numbers 2, 4 and 8'. In this instance, the record database 240 may apply higher weight information to a combination of cards which may not be generated in the conventional GOSTOP game method and also has a lower possibility since one user 120 rarely obtains all cards. As an example, when the user 120 obtains a pair of 'GODORIs', that is, 10GGUT cards of 'numbers 2, 4 and 8' by two cards, weight information '*4' may be applied to the point data '5points'. Accordingly, '20points' may be assigned to the user 120.

FIG. 5 is a diagram illustrating an example of a record database recording penalty information applied to a loser according to a winner's combination of cards after a game is over, according to another embodiment of the present invention.

As illustrated in FIG. 5, the record database 240 includes penalty information. The penalty information is additionally applied, when card data obtained by a loser does not satisfy a predetermined condition in association with card combination data recorded in a storage area of a winner who has selected termination of a game. FIG. 5 illustrates when the combination of cards associated with 'KWANG' is included in a winner's combinations of cards after the GOSTOP game is over (when the winner obtains total points in association with 'KWANG'). In this case, when deducting a loser's game points, the online GOSTOP game providing system 200 may check card data obtained by the loser and deduct game point information applied with '*2', from the loser having one card of 'KWANG' among card data. As an example, when a winner having total points '14points' generates a game termination signal and '3points' is game point information that a loser has to transfer to the winner, a loser having one card of 'KWANG' is applied by penalty information '*2' and has to transfer 6 game points to the winner. Also, when the winner's card combination data is identical, the online GOSTOP game providing system 200 may apply penalty information '*4' to a loser having no 'KWANG' and transfer '12game points' from the loser to the winner.

Also, in a game method according to an embodiment of the present invention, a predetermined weight may be additionally applied under the condition that a predetermined mission is completed.

A 'mission completion condition', with the assumption that a particular user 120 wins a corresponding GOSTOP game, may be fulfilled by predetermined mission information (e.g., "3GO", "4GO", and "5GO") or information on card combination data (e.g., "5KWANGs" and "CHUNGDAN") obtained by the user 120 in the GOSTOP game. In this instance, the mission information is that the user 120 wants to play in the GOSTOP game or information designated by an online GOSTOP game providing system according to an embodiment of the present invention. As an example, when the user 120 receives cards of numbers 2, 4 and 8 associated with 'GODORI', as distribution cards, the user 120 may input GODORI as the 'mission completion condition'. Also, the user 120 may initially input mission information that the user accomplishes "3GO" in a game when the game starts, before playing the game. Also, the system according to the present invention may provide predetermined mission information (e.g., "*4 when 3GO is accomplished"). As an example, when a predetermined event such as 'GO' is inputted from the user 120 while the game is in progress, the system may temporarily store the event in a predetermined record area as game log information. When the game is over, the system may analyze the game log information and determine whether the user 120 has fulfilled the mission information.

In this case, the record database 240 records weight information associated with the 'mission completion condition'. When card combination data obtained by a winner satisfies the 'mission completion condition', the weight information is multiplied with game point information to be deducted from the loser. Additional game points may be assigned to the winner. Also, when the user 120 inputs mission information, the record database 240 records the mission information and weight information corresponding thereto. After the game is over, when the user 120 accomplishes the mission information, the record database 240 may determine that the 'mission completion condition' is fulfilled.

In the above-described embodiment, when the user 120 who has inputted GODORI as the 'mission completion condition' wins the GOSTOP game and also has card combination data corresponding to GODORI among his/her card combination data, the game control module 250 determines that the 'mission completion condition' has been completed. Accordingly, the game control module 250 may transfer the game point information applied with weight information (e.g., *2), to the user 120 who is a winner.

Namely, in the above-described embodiment with respect to card combination data, the game control module 250 receives the 'mission completion condition' from the user 120. When the user 120 selects termination of the game, the game control module 250 determines whether card combination data obtained by the user 120 satisfies the 'mission completion condition'.

A game method according to a so-called 'bomb' will be described as a game method according to an embodiment of the present invention.

In the present invention, since a plurality of distribution cards is utilized, a plurality of identical kind of cards may be distributed. Also, the game control module 250 may group the plurality of identical kinds of cards as one group. In this case, when a card whose kind is identical to the grouped cards is designated as a BADAK card, the game control module 250 may provide the corresponding user 120 with a user interface. In this instance, the user interface enables the user 120 to simultaneously select the plurality of grouped cards in the user's 120 betting turn. This concept is identical to a "bomb" in an offline GOSTOP game. When a plurality of cards and a BADAK card match, the game control module 250 provides the user 120 with an option. The option includes an option capable of simultaneously selecting the plurality of cards, or an option capable of selecting one of the plurality of cards. The user 120 may select the option and play an online GOSTOP game according to the present invention.

In the present embodiment, a GOSTOP game method of the present invention is partially described with reference to FIGS. 3 to 5. The present invention is not limited thereto. It will be apparent to those skilled in the related art that various types of game methods may be generated from a GOSTOP game using a plurality of cards.

The game control module 250 distributes card data to the user 120 according to a predetermined algorithm, analyzes card data obtained by the user 120 according to the user 120's manipulation, and generates card combination data. Also, the game control module 250 extracts point data or weight information corresponding to the card combination data by referring to the record database 240. In this instance, the algorithm is to perform a GOSTOP game using a plurality of decks of cards on the basis of a MATGO game method. According to the algorithm, the game control module 250 controls a GOSTOP game to be in progress between at least two users 120 using a plurality of decks of cards. Also, the game control module 250 variously combines card data obtained by the user 120 according to the progress of the GOSTOP game and searches the record database 240 for a point corresponding to the card combination data. Also, the game control module 250 calculates points for each user 120 and records the calculated final point data in a predetermined storage area assigned for each user 120.

In the above-described embodiment, the game control module 250 distributes 20 cards, as card data, to two users 120 who have accessed the same game channel and allots 16 cards as BADAK cards (remaining cards total 44 cards), before starting the GOSTOP game. Also, when the user 120 obtains a pair of matched card data according to the progress of the GOSTOP game, the game control module 250 combines the obtained card data into various types and generates card combination data. In this instance, a combination of card data is generated on the basis of a combination type which can extract a maximum point when the combination is generated. As an example, a class of 10GGUT card with an identification number 9 may be selectively determined as 10GGUT or PI by the user 120. Through this, higher point data may be calculated. Also, the game control module 250 controls the point calculation module 260 to sum up points which is assigned to each combination of cards. When the total points satisfies a predetermined value, for example, 14 points, the game control module 250 may provide the corresponding user 120 with a user interface enabling the user 120 to select GO (continue a game)/STOP (terminate a game). If the user 120 selects the GO, the game continues. The user 120 may obtain additional points. When the user's 120 points satisfies another predetermined value, for example, 16 points, the game control module 250 provides the user 120 with a user interface again, such as a popup window, enabling the user 120 to select GO (continue a game)/STOP (finish a game).

The game control module 250 distributes a predetermined number of first card data (distribution cards) to the user 120 playing a game and displays a portion of second card data, except for the distributed card data, from at least two decks of cards, to the user 120 (BADAK cards). Also, the game control module 250 checks whether one card data selected by the user 120 from the first card data (distribution cards) and the second card data (BADAK cards) match. When matching, the game control module 250 records the matched first and second card data in a predetermined storage area assigned to the corresponding user 120. This process is a first betting step in the user's 120 betting turn. In this process, the user 120 selects and bets one card data from his/her distributed card data. A BADAK card matching the betted card data may be determined to be obtained by the user 120. In this instance, the game control module 250 requests the corresponding user 120 to bet at least one card data in his/her betting turn. When not matching, the game control module 250 converts the betted card data into a BADAK card and waits for the user's 120 second betting.

In the second betting step, the game control module 250 checks whether the second card data (BADAK cards) displayed to the user 120 and card data distributed to the user 120 among not displayed second card data (waiting card) match. When matching, the game control module 250 stores the matched card data in a predetermined storage area assigned to the user 120. This is a process of comparing card data allotted for the user 120 and BADAK cards. Namely, this is a process of making the user obtain a pair of matched card data and converting unmatched card data into a BADAK card.

When the first card data (distribution card) and displayed second card data (BADAK card) or the displayed second card data (BADAK card) and not-displayed second card data allotted for the user 120 (waiting card) are of a same kind (e.g., "identification number 5") or identical (e.g., "5GGUT of identification number 5"), the game control module 250 controls matching to be performed. Namely, the game control module 250 supports the conventional method of matching cards of the same kind (same identification number) and also supports a method of matching cards of the same type (identification suit) and also supports a method of matching same cards and making a user obtain a pair of corresponding card data. As an example, when 'BIKWANG' of identification number 12 is placed as a BADAK card and the same 'BIKWANG' is betted as a distribution card (or a waiting card), a pair of 'BIWANGs' may be recorded in the user 120's storage area.

Also, the game control module 250 sums up point data assigned to each card combination data. When calculated total point information reaches a certain value, the game control module 250 temporarily stops a game and receives confirmation data for continuing a game, from a winner whose total point information has reached the value. This is a process of waiting for a selection from a winner, about whether to continue a game. If the winner selects 'GO (continue a game)' and transmits confirmation data, the game control module 250 continues a game and also records log information in the winner's storage area. In this instance, the log information includes the record of 'GO'.

Also, when a winner selects termination of a game, the game control module 250 deducts a predetermined amount of game point information from a loser's game point information by referring to the user information database 210, and records the results of the deduction. Also, the game control module 250 adds the deducted total game point information to the winner's game point information. Namely, when calculated total points of the particular user 120 satisfies a predetermined value and, because of this, a game termination signal is generated by the user 120, the game control module 250 terminates the game and controls game point information to be distributed to the users 120 playing the game. In this instance, various conditions of penalty information may be applied to a loser. When the loser's card data does not satisfy a certain standard in association with the winner's card combination data, the game control module 250 applies a predetermined weight to the loser's game point information and deducts the results of application from game point information recorded in the loser's storage area (see FIG. 5).

In particular, when first card data (distribution card) and displayed second card data (BADAK card) and not-displayed card data allotted for the user 120 (waiting card) are of a same kind or identical in the user's 120 betting turn, the game control module 250 controls matching to not be satisfied. Namely, the game control module 250 may apply 'BBUG' to the same kind of cards and also to the identical cards. In this instance, 'BBUG' is one type of GOSTOP game methods. As an example, when 'BIKWANG' of identification number 12 is included in BADAK cards and 'BIKWANG' is selected as distribution cards to be betted by the user 120, the game control module 250 may determine that matching between card data of two 'BIKWANG's has been performed in a first betting step. In this instance, when a waiting card allotted for the user 120 is a kind included in identification number 11, the game control module 250 determines that a correlation among three card data (two BIKWANGs and card data included in identification number 11) may not be matched, and converts the three card data into BADA cards. After this, matching with respect to the 'BBUG' processed card data may be processed on the basis of a general GOSTOP game. Detailed description related thereto will be omitted herein.

The point calculation module 260 calculates total point information obtained by the user 120 by using point information or weight information. Also, the point calculation module 260 provides the user 120 with calculated total point information. Namely, the point calculation module 260 calculates total points corresponding to each generated card combination data. Also, the point calculation module 260 provides the user 120 playing the game with the user's 120 current point information in real time. When a game termination signal is generated by the particular user 120, the point calculation module 260 calculates game point information to be transferred to a winner. Namely, the point calculation module 260 deducts a portion of a loser's game point information and adds the same to a winner.

According to the present invention, a GOSTOP game service using a plurality of decks of cards is provided in which a modified game method and calculation of points based on various combinations of cards are applied. Accordingly, it is possible to increase an interest of a user playing a GOSTOP game.

A GOSTOP game using a team play according to another embodiment of the present invention will be described with reference to FIGS. 6 and 7.

In a GOSTOP game using a team play, the GOSTOP game is in progress between teams consisting of a plurality of users 120. According to the team play GOSTOP game according to the present embodiment, a GOSTOP game using various types of team plays may be provided on the basis of a method of distributing card data (distribution cards) and a method of managing card data obtained in a game.

Figure 6:
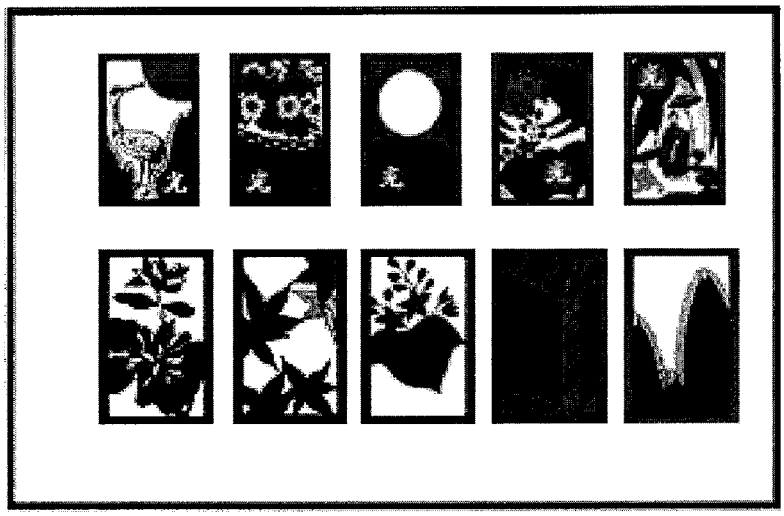
FIGS. 6 and 7 are diagrams illustrating an example of a GOSTOP game using a team play according to an embodiment of the present invention.
Figure 6:
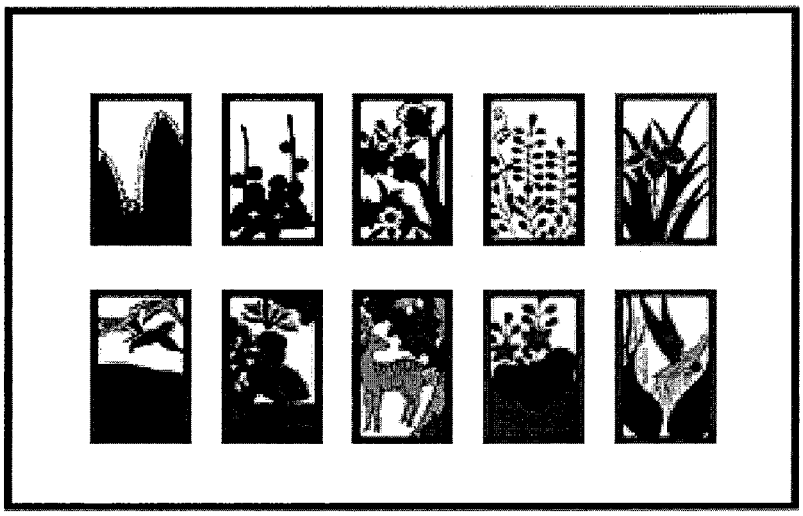
Figure 7:
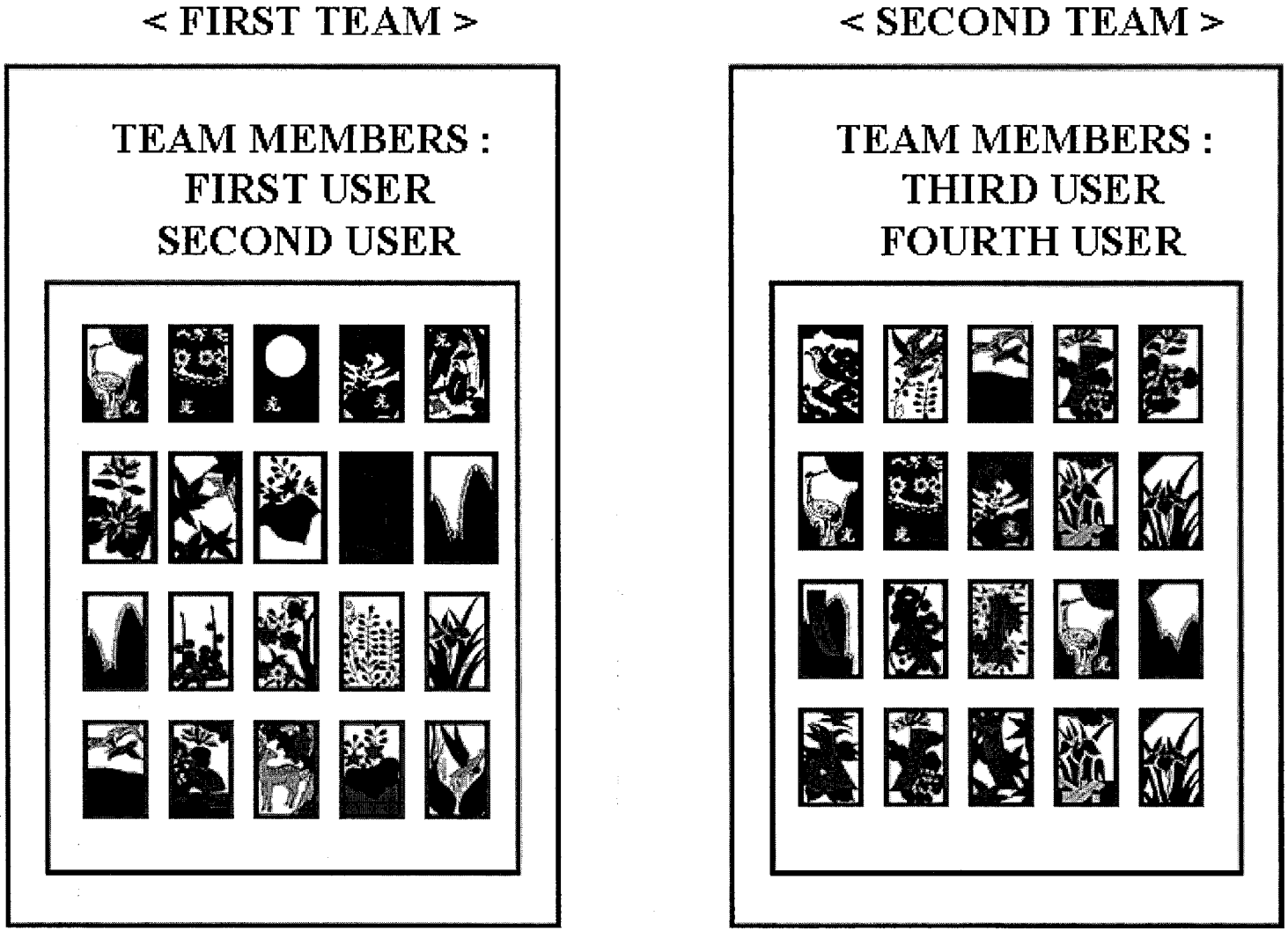

FIGS. 6 and 7 are diagrams illustrating an example of a GOSTOP game using a team play according to an embodiment of the present invention in which a method of distributing card data for each team member and a method of distributing card data for each team are provided as examples.

The online GOSTOP game providing system 200 may progress a game according to two distribution methods of card data (distribution cards), which include a first distribution method of distributing card data for each team to make team members share the distribution cards and a second distribution method of distributing card data for each team to distribute the card data to each team member.

Also, when calculating team points, the online GOSTOP game providing system 200 may adopt any one of two methods, which include a first calculation method of calculating points of each team member belonging to a team and summing up the same and a second calculation method of calculating team points by collecting all card data obtained by each team member and generating card combination data and calculating point data corresponding to the card combination data.

When the first and the second distribution methods, and the first and the second calculation methods are applied, four types of team play online GOSTOP games are provided by using different combinations.

To provide a team play GOSTOP game, the online GOSTOP game providing system 200 may further include a team control module 270. The team control module 270 may control a game team including at least one second user to be organized according to a user's selection.

Referring to FIG. 6, a game team has a first user and a second user. The team control module 270 organizes the first and the second users as one team, and collects and records card data and point data with respect to the game team. Namely, in FIG. 6, card data is individually distributed to each team member belonging to the same team (second distribution method). Also, point data is calculated according to progress of a game and the calculated point data is managed for each team (second calculation method).

Also, in FIG. 6, the game control module 250 distributes card data (10 cards) to each of the first user and the second user. The first user and the second user select the distributed card data and play a game. Also, when playing a GOSTOP game of the present invention, a betting turn may be assigned to each team in turn. A betting turn of each team may be assigned to each team member in turn.

Referring to FIG. 7, a first team and a second team are divided by the team control module 270. In this instance, the first team has a first user and a second user, and the second team has a third user and a fourth user. The team control module 270 collects and records card data distributed to the first and second teams, and point data thereof. Namely, in FIG. 7, card data is distributed to each team and distributed card data is bet in turn by a user of each team.

In this instance, the game control module 250 distributes card data to the first team and the second team (first distribution method), and users who are team members select the distributed card data.

In the present embodiment, the game control module 250 may distribute 20 card data to each team. Team members of the first team (first and second users) select at least one card data from its distributed card data. Also, team members of the second team (third and fourth users) select at least one card data from its distributed card data.

After this, card data obtained by team members of each team in a game may be managed by the same method as described in FIG. 6. That is, the card data may be managed for each user (first calculation method) or for each team (second calculation method).

According to the present invention, a GOSTOP game method using a plurality of decks of cards may be expanded to a team play method using a plurality of users. Accordingly, gamers' various demands may be satisfied.

The 'mission completion condition' as described above may be applied to a team play GOSTOP game using a plurality of decks of cards which is provided in an online GOSTOP game providing system according to an embodiment of the present invention. As an example, if the 'mission completion condition' is achieved by receiving mission information or receiving a selection about a mission completion condition corresponding to predetermined card combination data, from a team member belonging to a predetermined team when a game starts, and completing the mission information or obtaining the card combination data while at least two team members of each team play the game, the system may be constructed to multiply a predetermined weight and total point data of the team. As an example, when card combination data selected by a user of a corresponding team is 'all team members CHUNGDAN' or 'all team members at least 3KWANGs', team members of the team may obtain card combination data corresponding to CHUNGDAN or at least 3KWANGs and satisfy a predetermined game termination condition while the game in progress. In this case, the 'mission completion condition' is determined to be completed. Accordingly, weight information "4" may be applied to total point information of the team. Also, as an example of embodying the system, when a predetermined event (e.g., 'GO') is received from the user while the game in progress, the system according to the present invention temporarily stores the event, as log information, in a predetermined record area. When the game is over, the system analyzes the log information and determines whether the user has completed the mission information, as described above.

In various types of game methods which may be provided in the online GOSTOP game providing system according to the present invention, various modifications and changes may be conceived on the basis of a configuration providing an online GOSTOP game using at least two decks of cards. The present invention's main spirit is using at least two decks of cards. It will be apparent to those skilled in the related art that various and changes may be made thereto without departing from the scope and spirit of the invention defined by the claims appended thereto and their equivalents.

An operation of the online GOSTOP game providing system 200 constructed as above according to the present invention will be described in detailed.

Figure 8:
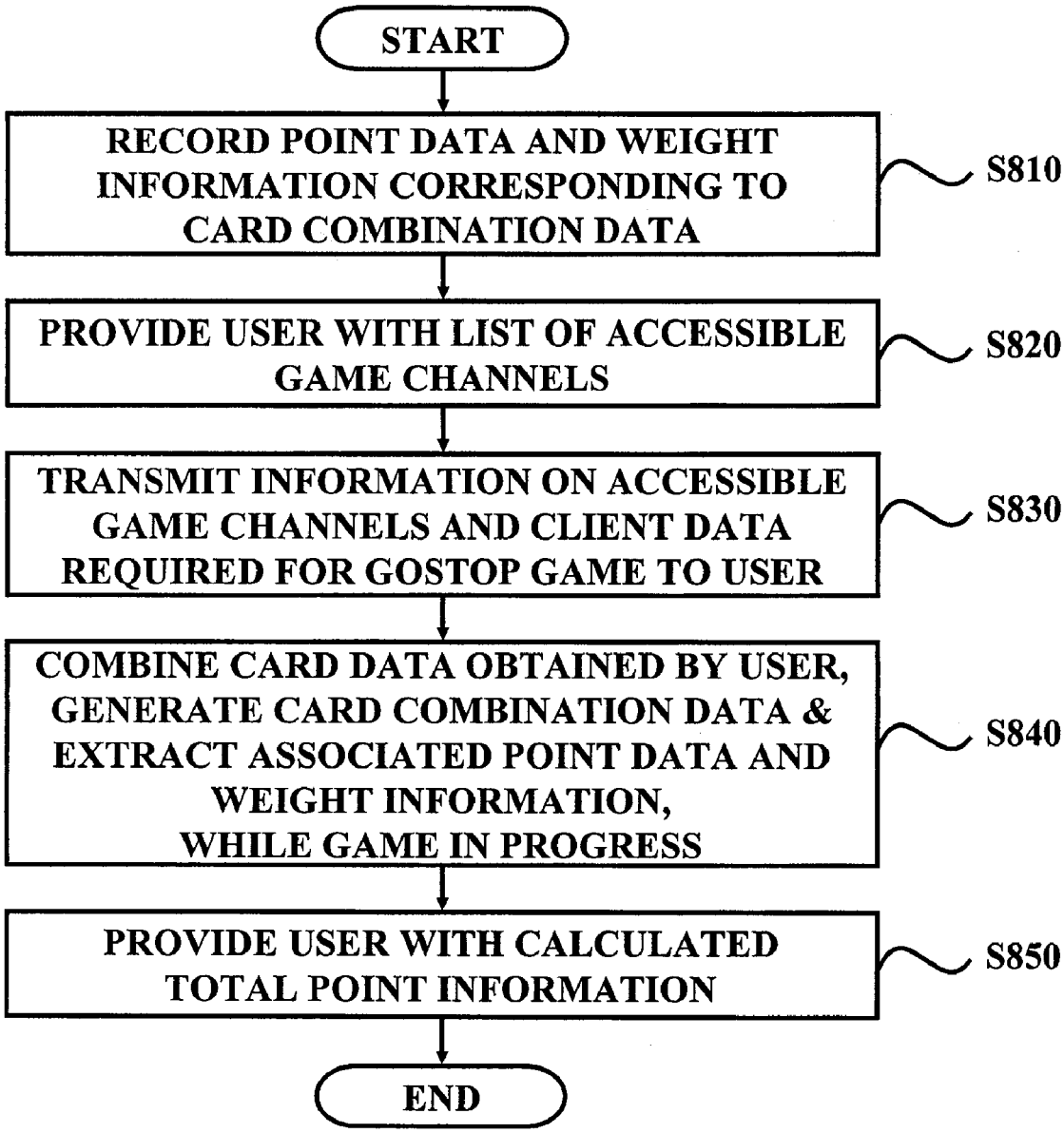
FIG. 8 is a flowchart illustrating a GOSTOP game service method according to an exemplary embodiment of the present invention.

FIG. 8 is a flowchart illustrating a GOSTOP game service method according to an embodiment of the present invention.

The GOSTOP game service method according to the present embodiment is performed by the online GOSTOP game providing system 200.

In step S810, the online GOSTOP game providing system 200 maintains the user information database 210 and the record database 240. The user information database 210 records account information of at least one user 120 and game point information thereof. Also, the record database 240 records predetermined point data or weight information corresponding to card combination data which is at least one combination of card data. Namely, this step S810 is a process of recording game point information in the user information database 210. In this instance, the game point information is utilized for providing the particular user 120 with a GOSTOP game service and maintained for each user 120. Also, this step S810 is a process of recording point data corresponding to at least one card combination data in the record database 240. In this instance, the at least one card combination data may be generated when a GOSTOP game is in progress using a plurality of decks of cards. In particular, the record database 240 may set point data differently corresponding to each card combination data, on the basis of a possibility that a combination of cards may be generated. For this, predetermined weight information corresponding to each card combination data may be recorded.

In step S820, the online GOSTOP game providing system 200, in response to a request for providing a GOSTOP game service from the at least one user 120, provides the user 120 with a list of game channels that the user 120 can access. This step S820 is a process of making a list with respect to game channels (game rooms) allowing the user 120 to access. When the user 120 accesses the online GOSTOP game providing system 200, the same provides the user 120 with the list of game channels that the user 120 can access.

In step S830, the online GOSTOP game providing system 200 receives a selection signal on the list of game channels from the user 120 and transmits information on a game channel and client data necessary for a GOSTOP game, to user terminals of a plurality of users 120 accessing the game channel. This step S830 is a process of providing the user 120 with all types of game data and all types of information on the game channel accessed by the user 120. Through this, the user 120 may be provided with game channel information and information on a opposing party who plays a GOSTOP game together. An example of the game channel information has been described above.

In step S840, the online GOSTOP game providing system 200 randomly distributes at least two decks of cards, as card data, to the user 120 playing a GOSTOP game, analyzes card data obtained by the user 120, according to the user's 120 manipulation, generates card combination data, and extracts point data or weight information corresponding to the card combination data by referring to the record database 240. This step S840 is a process of combining obtained card data in a GOSTOP game and searching the record database 240 for point data corresponding to the combined card combination data. In particular, in step S840, when a GOSTOP game is in progress using a plurality of decks of cards, the online GOSTOP game providing system 200 generates various combinations of cards which may not be generated in the conventional GOSTOP game. Point data applied with predetermined weight information corresponds to the new combination of cards (see FIG. 5).

In step S850, the online GOSTOP game providing system 200 calculates total point information obtained by the user 120, by using extracted point data or weight information, and provides the user 120 with the calculated total point information. This step S850 is a process of combining card data obtained by the user 120 in a game, generating card combination data, calculating point data corresponding to each card combination data on the basis of weight information, and providing the user 120 with the calculated point data in real time. After this, when the total point information reaches a predetermined value, the online GOSTOP game providing system 200 gives an opportunity to the user to select GO(continue a game)/STOP(terminate a game). When STOP is selected, the online GOSTOP game providing system 200 controls a predetermined amount of game point information to be deducted from a loser and added to a winner according to winning/losing of a game.

Namely, according to the present invention, a GOSTOP game service using a plurality of decks of cards is provided. Accordingly, it is possible to generate combinations of cards that may not be generated in the conventional GOSTOP game method and increase the user's 120 interests in a game.

The embodiments of the present invention include computer readable media including program instructions to implement various operations embodied by a computer. The media may also include, alone or in combination with the program instructions, data files, data structures, tables, and the like. The media and program instructions may be those specially designed and constructed for the purposes of the present invention, or they may be of the kind well known and available to those having skill in the computer software arts. Examples of computer-readable media include magnetic media such as hard disks, floppy disks, and magnetic tape; optical media such as CD ROM disks; magneto-optical media such as floptical disks; and hardware devices that are specially configured to store and perform program instructions, such as read-only memory devices (ROM) and random access memory (RAM). The media may also be a transmission medium such as optical or metallic lines, wave guides, etc. including a carrier wave transmitting signals specifying the program instructions, data structures, etc. Examples of program instructions include both machine code, such as produced by a compiler, and files containing higher level code that may be executed by the computer using an interpreter.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

INDUSTRIAL APPLICABILITY

According to the present invention, there is provided an online GOSTOP game providing method and system which can provide a GOSTOP game service using a plurality of decks of cards and, through this, calculate points according to various combinations of cards and apply a different game method from the conventional GOSTOP game, thereby increasing an interest of a user playing a GOSTOP game.

Also, according to the present invention, there is provided an online GOSTOP game providing method and system in which matching is performed when a plurality of card data is of a same kind or identical, and various types of card data can be obtained.

Also, according to the present invention, there is provided an online GOSTOP game providing method and system which can increasing a user's interests and entertainment by supporting various types of team plays, when a GOSTOP game is played using a plurality of decks of cards.

The invention claimed is:

1. A system comprising a processor coupled to a computer-implemented module to provide an online GOSTOP game, the system comprising:

a user information database, coupled to the computer-implemented module, configured to record account information of at least one user and game point information thereof;

a channel management module configured to provide at least one user with a list of accessible game channels in response to a request for providing a GOSTOP game service from the at least one user;

an information transmission module configured to receive a selection signal pertaining to the list of game channels from the user and transmitting information on a game channel corresponding to the selection signal and client data to progress the GOSTOP game to a user terminal accessing the game channel;

a record database, coupled to the computer-implemented module, to record predetermined game rules wherein the game rules comprise predetermined point data corresponding to card combination data which is at least one combination of card data;

a game control module configured to distribute the card data to the user according to a predetermined rule, to analyze the card data, by the processor, played by the user, to generate the card combination data based upon the analyzed card data, and to extract point data corresponding to the card combination data by referring to the record database; and a point calculation module configured to calculate, by the processor, total point information obtained by the user by using the point data.

2. The system of claim 1, wherein the game control module is configured to:

distribute a predetermined number of first card data to the user playing the game;

display a portion of second card data to the user, the second card data excluding the distributed card data from at least two decks of cards;

check whether selected card data by the user from the first card data and the second card data matches to store the matched first and second card data in a predetermined storage area assigned to the user; and temporarily stop the game when the total point information calculated by the point calculation module reaches a predetermined value.

3. The system of claim 2, wherein the game control module is configured to check whether second card data displayed to the user and card data allotted for the user from second card data not being displayed to the user matches, and to record the matched card data in a predetermined storage area assigned to the user.

4. The system of claim 3, wherein the game control module is configured to control the matching, if the first card data and the displayed second card data or the displayed second card data and the second card data not being displayed to the user are determined identical.

5. The system of claim 2, wherein the record database further comprises a predetermined condition associated with a combination of card data being recorded in the winner's storage area and at least one penalty information corresponding to the condition and the point calculation module deducts the loser's game point information by applying the penalty information, if card data recorded in the loser's storage area does not satisfy a condition associated with the combination of card data recorded in the winner's storage area.

6. The system of claim 1, wherein the record database record weight information corresponding to the card combination data is extracted by referring to the record database, and the point calculation module calculates total point information obtained by the user by using the point data and the weight information.

7. The system of claim 6, wherein the weight information recorded in the record database is obtained by multiplying point data corresponding to a particular combination of card data obtained by the user, the particular combination comprising at least one of predetermined number of combinations of KWANG cards, at least one predetermined number of combinations of PI cards, two combinations of GODORI cards, two combinations of CHUNGDAN cards, two combinations of HONGDAN cards and two combinations of CHODAN cards.

8. The system of claim 6, wherein the weight information recorded in the record database to be multiplied with game point information is deducted from the loser when a particular combination of card data obtained by the winner satisfies a predetermined mission completion condition, the mission completion condition comprising a predetermined at least one card combination data or a predetermined mission information designated by the user or the online GOSTOP game providing system, and the game control module receives the mission completion condition from the user, and if the user selects termination of the game, the game control module determines whether the user's card combination data or the mission information corresponds to the mission completion condition.

9. The system of claim 1, wherein the game control module allows users to play the online GOSTOP game with a plurality of decks of cards.

10. The system of claim 1, further comprising:

a team control module configured to organize a game team comprising at least one second user according to the user's selection, and to record card data distributed to the user and the at least one other users belonging to the game team and point data of the game team.

11. The system of claim 10, wherein the distributed card data by the game control module is a game team card data for the game team, and the user and the other users select at least one card data from the game team card data.

12. The system of claim 10 wherein the distributed card data by the game control module is a personal card data distributed for each of the at least one user belonging to the game team, and the user and the other users select at least one card data from the personal card data.

13. The system of claim 12, wherein the game control module collects the card data obtained by the user and the other users, and generates the card combination data.

14. The system of claim 12, wherein the game control module generates the card combination data with respect to each of the card data obtained by the user and the other users.

15. The system of claim 10, wherein the weight information recorded in the record database to be multiplied with game point information is deducted from the loser when a particular combination of card data obtained by the winner satisfies a predetermined mission completion condition, the mission completion condition comprising a predetermined at least one card combination data or a predetermined mission information designated by the user or the online GOSTOP game providing system, and the game control module receives the mission completion condition from the user and, if the user selects termination of the game, determines whether the user's card combination data or the mission information corresponds to the mission completion condition.

16. The system of claim 15, wherein:

the weight information recorded in the record database to be multiplied with game point information is deducted from a user of a losing team if the winning team satisfies a predetermined mission completion condition, the mission completion condition comprising the predetermined at least one card combination data or a predetermined mission information designated by the user of the winning team or the online GOSTOP game providing system, and the game control module receives the mission completion condition from the user of the winning team, and if the user selects termination of the game the game control module determines whether the winning team's card combination data or the mission information corresponds to the mission completion condition.

17. A system comprising a processor coupled to a computer-implemented module to provide an online GOSTOP game, the system comprising:

a channel management module configured to control a plurality of users to access a predetermined game channel in response to a request for providing a GOSTOP game service from the plurality of users;

a record database, coupled to the computer-implemented module, to record point data or weight information corresponding to each card combination data which is at least one combination of card data;

a game control module configured to provide the plurality of users accessing the game channel with the GOSTOP game service by utilizing at least two decks of cards; and a point calculation module configured to compare the record database with card combination data which is generated from a card data obtained by the user via the GOSTOP game service, and to calculate, by the processor, game point information to be provided to the user by using corresponding point data or weight information, wherein the game control module determines whether a correlation between randomly distributed card data to a predetermined user and a portion of displayed card data to the user among card data not being displayed to the user exists and when the above two card data are determined to be identical, and determines that the correlation exists and records the card data in a predetermined storage area assigned to the user.

18. A computer-implemented method for providing an online GOSTOP game, the method comprising:

maintaining a user information database recording account information of at least one user and game point information thereof and a record database recording predetermined point data or weight information corresponding to card combination data which is at least one combination of card data;

providing the at least one user with a list of accessible game channels in response to a request for providing a GOSTOP game service from the at least one user;

receiving a selection signal pertaining to the list of game channels from the user and transmitting information on a predetermined game channel corresponding to the selection signal and client data necessary for progressing the GOSTOP game to user terminals of a plurality of users accessing the game channel;

randomly distributing at least two decks of cards, as card data, to a user playing the game, analyzing card data obtained by the user according to the user's manipulation, generating card combination data, and extracting point data or weight information corresponding to the card combination data by referring to the record database; and calculating total point information obtained by the user by using the extracted point data or weight information and providing the user with the calculated total point information.

19. A non-transitory computer readable record storage medium comprising an executable program, which when executed, performs the method of claim 18.

20. A computer-implemented method using a processor coupled to a control module for providing an online GOSTOP game, the method comprising:

providing a plurality of decks of playing GOSTOP cards, each deck sharing a multiplicity of identical cards, wherein the plurality of decks are mixed together and the decks comprising a first card data and a second card data, the first card data corresponding to the shared multiplicity cards and the second card data excluding the shared multiplicity cards;

dealing a first predetermined number of playing GOSTOP cards from said plurality of decks, thereby forming a player hand, wherein the control module to check whether selected card data by a user from the first card data and the second card data matches to store the matched first and second card data in a predetermined storage area assigned to the user;

analyzing, by the processor, the selected card data played by a user;

generating card combination data based, at least in part, upon said analyzed card data; and calculating, by the processor, total point obtained by the user according to a predetermined game rules wherein the total point is calculated based, at least in part, upon said generated card combination data.

21. The computer-implemented method of claim 20, wherein the total point is calculated based, at least in part, upon a predetermined point data.

22. The computer-implemented method of claim 20, wherein the total point is calculated based, at least in part, upon a predetermined point data and a predetermined weight information.

* * * * *